United States Patent [19]

Boyle

[11] 4,117,559

[45] Oct. 3, 1978

[54] BATHROOM DEODORIZER AND ODORIZER DEVICES AND METHODS OF MAKING AND USING THE SAME

[76] Inventor: Delbert D. Boyle, 1354 Lee Dr., Edwardsville, Ill. 62025

[21] Appl. No.: 801,471

[22] Filed: May 31, 1977

[51] Int. Cl.[2] ..... E03D 9/04

[52] U.S. Cl. ..... 4/209 R; 4/213; 4/216; 4/348

[58] Field of Search ..... 4/213, 216, 217, 209 FF, 4/209 R, 72, 83, 94, 96, 106, 348

[56] References Cited

U.S. PATENT DOCUMENTS

| | | | |
|---|---|---|---|
| 2,309,885 | 2/1943 | Carman | 4/213 |
| 3,689,944 | 9/1972 | Clayton | 4/213 |
| 3,781,923 | 1/1974 | Maisch et al. | 4/216 |
| 3,790,970 | 2/1974 | Bendersky et al. | 4/217 |
| 3,913,150 | 10/1975 | Poister et al. | 4/213 |

*Primary Examiner*—Richard E. Aegerter
*Assistant Examiner*—L. Footland

[57] ABSTRACT

A bathroom deodorizer and odorizer for use with a conventional toilet bowl comprising housing means, said housing means provided with a motor chamber therein, said motor chamber opening externally of said housing, said housing provided with first and second inlet ports and chambers and first and second outlet ports and chambers, said first inlet port and chamber communicating with said first outlet port and chamber and said second inlet port and chamber communicating with said second outlet port and chamber, motor means provided with a first and second fan means operably mounted in said motor chamber, said first fan means disposed in said first outlet chamber and said second fan means disposed in said second outlet chamber, said motor means provided with energy coupling means operably mounted thereon, a motor chamber cover provided with energy coupling means operably mounted thereon operably mounted on said housing means, deodorizing or odorizing wafer removably disposed in said first and second inlet chambers apertured end covers mounted on said outlet ports, bowl seal means operably disposed proximate said housing means, switching means operably disposed in said seal means and operably connected to said energy coupling means on said motor chamber cover, said housing means shaped to fit within the open contour of a conventional bowl and lid and clip means mounted on said housing means.

1 Claim, 5 Drawing Figures

BATHROOM DEODORIZER AND ODORIZER DEVICES AND METHODS OF MAKING AND USING THE SAME

BACKGROUND OF THE INVENTION

A common unsatisfactory situation occurs as a result of the objectionable odors arising from a toilet bowl. Devices which have attempted a solution to this in the past generally comprise a class of room blowers. Other devices which have been created in the past require entire toilet seat and lid modification thus resulting in excessive expense and impractical devices.

SUMMARY OF THE INVENTION

The present invention contemplates a device which will be disposed proximate the bowl will draw off the objectionable odors, pass them through a deodorizing or odorizing filter or wafer and then discharge these deodorized or pleasantly odorized aromas into the room. A device is contemplated which will maximize the air gathering function, function automatically and be constructed and shaped such that it is compatible with standard available toilet seats and lids thus eliminating the necessity of constructing an expensive toilet seat.

A primary purpose then of the present invention is to provide such a device which requires no modification to the existing toilet seat and lid and requires a minimum of parts thus achieving a practicability not heretofore achieved.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 1:
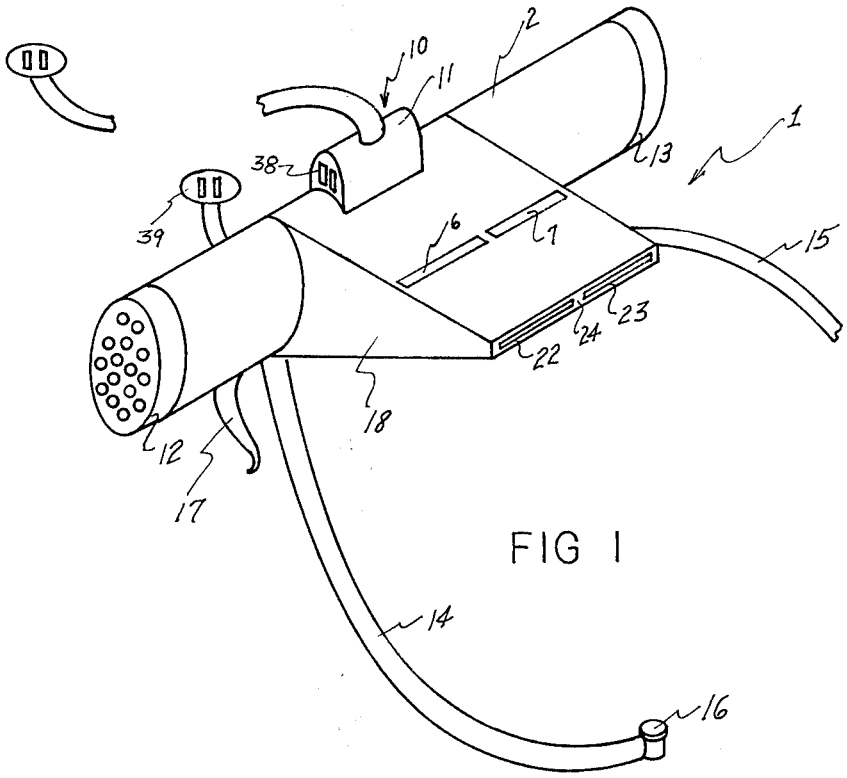
FIG. 1 is a partial perspective view of a bathroom deodorizer and odorizer device constructed in accordance with and embodying the present invention.

Referring now in more detail and by reference characters to the drawings which illustrate practical embodiments of the present invention, FIG. 1, is a partial perspective view of a bathroom deodorizer and odorizer device, 1, constructed in accordance with, used in and embodying the present invention.

Figure 4:
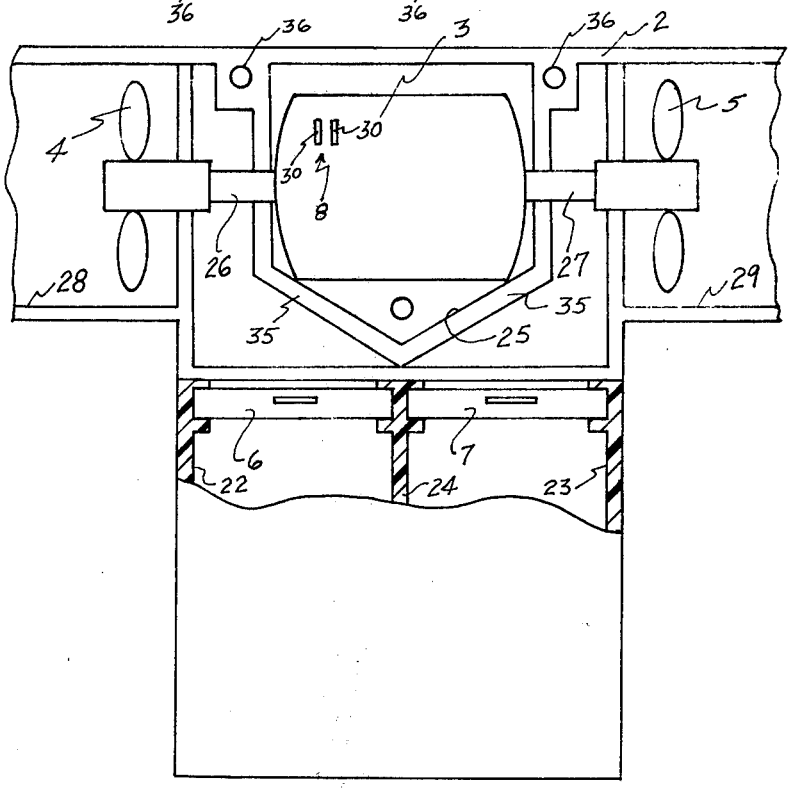
FIG. 4 is a partial plan view of the device shown in FIG. 1.

As shown in FIG. 1, and FIG. 4, device, 1, is shown to comprise housing means, 2, motor means, 3, fan means, 4, and, 5, deodorizing or odorizing filters or wafers, 6, and 7, energy coupling means, 8, mounted on motor, 3, motor chamber cover, 9, provided with energy coupling means, 10, and, 11, exhaust covers, 12, and, 13, bowl seals, 14, and, 15, switching means, 16, and clip means, 17.

Figure 2:
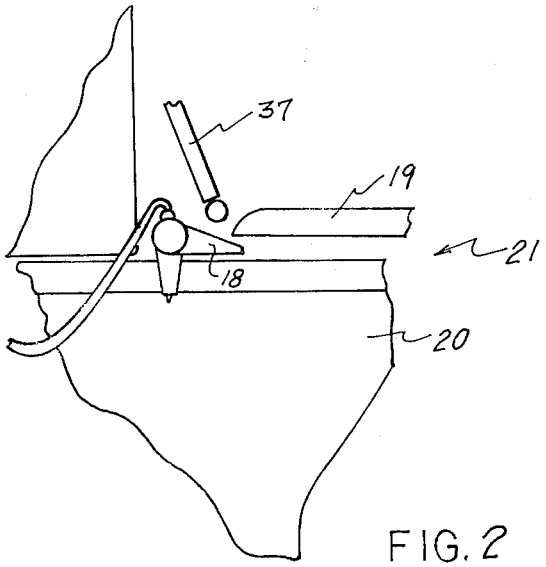
FIG. 2 is a partial elevation view of the bathroom deodorizer and odorizer device in FIG. 1, installed.
Figure 3:
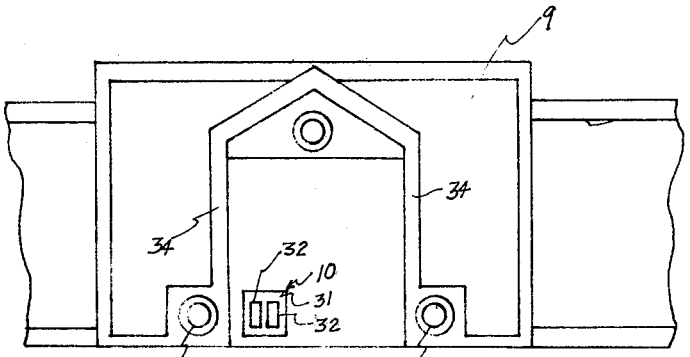
FIG. 3 is a partial plan view of the bathroom deodorizer and odorizer shown in FIG. 1.
Figure 5:
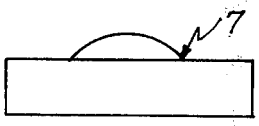
FIG. 5 is an elevation view of a deodorizer used in the device shown in FIG. 1.

FIG. 1, shows the contour of the bowl portion, 18, of housing, 2, which is shaped in bill fashion to fit between the seat, 19, and bowl, 20, of the conventional bowl assembly, 21, shown in FIG. 2. Bowl portion, 18, of housing, 2, is seen to be divided into two inlet chambers, 22, and 23, separated by divider, 24, which also provides structural integrity. Motor, 3, is seen in FIG. 4, to be mounted in motor chamber, 25, thus separating the motor, 3, from the moisture which will be present. Shafts, 26, and, 27, support air displacement fans, 4, and, 5, disposing them in outlet chambers, 28, and, 29. Wafers, 6, and, 7, are shown removably mounted in housing, 2, and disposed in inlet chambers, 22, and 23. Wafer, 7, is also shown in FIG. 5. Male plugs, 30, are shown extending from motor, 3, adapted to engage female connector, 31, and contacts, 32, on motor chamber cover, 9. As shown in FIG. 3, motor chamber cover, 9, is provided with walls, 34, to align with walls, 35, on housing, 2, to form chamber, 25. Screw holes, 36, in cover, 9, align with screw holes, 36, in housing, 2, to allow assembly using three conventional screws.

FIG. 2, shows device, 1, clipped onto a conventional toilet seat assembly in a safe configuration, isolating conductors and plugs with such being disposed behind the lid, 37. FIG. 1 also shows seals, 14, and, 15, which are adapted to be disposed between seat, 19, and bowl, 20, allowing a minimum escape of objectionable odors. Also shown in FIG. 1, is switch, 16, a pressure switch which is adapted to engage and cause energization of motor, 3, via conductors disposed within seal, 14, and connected to socket, 38, by means of plug, 39.

It should be understood that changes and modifications in the form, construction, arrangement, and combination of the bathroom deodorizer and odorizer device and methods of making and using the same may be made and substituted for those herein shown and described without departing from the nature and principle of my invention.

Having thus described my invention, what I claim is new and desire to secure by United States Letters Patent is:

1. A bathroom deodorizer and odorizer device for use with a conventional toilet bowl comprising, housing means, said housing means provided with a motor chamber therein, said housing means provided with first and second inlet ports and chambers and first and second outlet ports and chambers, said first inlet port and chamber communicating with said first outlet port and chamber and said second inlet port and chamber communicating with said second outlet port and chamber, motor means provided with a first and second shaft and fan means operably mounted in said motor chamber, said first fan means disposed in said first outlet chamber and said second fan means disposed in said second outlet chamber, said motor means provided with first energy coupling means operably mounted thereon, a motor chamber cover provided with second energy coupling means operably mounted thereon operably mounted on said housing means, said first and second energy coupling means disposed to engage with each other when said cover is in place, said housing means shaped in the form of an elongated cylinder with the axis thereof essentially parallel to said motor shaft means in combination with a bill portion attached to external wall of said cylinder, said bill portion having a rectangular cross section which decreases in width as the distance from the cylinder increases, said inlet ports and chambers disposed transverse to the axis of said cylinder and within said bill portion, said outlet ports and chambers disposed longitudinally within said cylinder, deodorizing and odorizing wafers removably disposed in said first and second inlet chambers apertured and covers operably mounted on said outlet ports at opposite ends of said cylinder, bowl seal means operably disposed proximate said housing means, switching means operably disposed in said seal means and operably connected to said energy coupling means on said motor chamber cover, said housing means shaped to fit within the open contour of a conventional bowl and lid and clip means mounted on said housing means.

* * * * *